US005923352A

United States Patent [19]

Kikuchi et al.

[11] Patent Number: 5,923,352

[45] Date of Patent: Jul. 13, 1999

[54] METHOD OF ADJUSTING ELECTROMECHANICAL ELEMENT OF INK JET PRINT HEAD TO INCREASE UNIFORMITY OF PERFORMANCE CHARACTERISTIC

[75] Inventors: Hiroshi Kikuchi; Mitsuru Kishimoto; Kiyoshi Ikeda; Masahiko Shimosugi, all of Tokyo, Japan

[73] Assignee: Oki Data Corporation, Tokyo, Japan

[21] Appl. No.: 08/814,110

[22] Filed: Mar. 10, 1997

[30] Foreign Application Priority Data

Mar. 13, 1996 [JP] Japan ..... 8-056183
Dec. 16, 1996 [JP] Japan ..... 8-335874

[51] Int. Cl.[6] ..... B41J 2/045

[52] U.S. Cl. ..... 347/70; 347/68; 310/358; 29/25.35

[58] Field of Search ..... 347/68–72; 310/311, 310/313, 357, 359, 365, 316, 328, 358; 29/25.35

[56] References Cited

U.S. PATENT DOCUMENTS 5,666,144 9/1997 Zhang ..... 347/69

OTHER PUBLICATIONS

Patent Abstract of Japan, vol. 17, No. 7, (Dec. 22, 1993), JP 5–243884 A (Murata MFG Co, LTD).

Wang et al., "Peizoelectric Porperties of PLZT Ceranics At Differnt Remanent Polarization Levels," 1990 IEEE 7th International Symposium on Applications of Ferroelectrics, 1991.

*Primary Examiner*—N. Le
*Assistant Examiner*—C. Dickens
*Attorney, Agent, or Firm*—Rabin & Champagne, P.C

[57] ABSTRACT

A method of adjusting an ink jet head having at least one polarized electromechanical transducer forming an ink pressure chamber from which ink drops are ejected when the electromechanical transducer is deformed. The method includes the steps of performing a first polarization operation where the electromechanical transducer is polarized into saturation in a first direction, and performing second polarization operation where the electromechanical transducer polarized by the first polarization operation is polarized in a second direction opposite to the first direction so that the electromechanical transducer is polarized to a predetermined level.

11 Claims, 5 Drawing Sheets

PRIOR ART

METHOD OF ADJUSTING ELECTROMECHANICAL ELEMENT OF INK JET PRINT HEAD TO INCREASE UNIFORMITY OF PERFORMANCE CHARACTERISTIC

BACKGROUND OF THE INVENTION

1. Technical Field of the Invention

The present invention relates to an ink jet head for an ink jet type recording apparatus and more particularly to a method of adjusting the characteristics of the piezoelectric material used for the ink jet head.

2. Description of Related Art

Most conventional ink jet heads are of a type in which ink drops are ejected by pressure resulting from the deformation of an electromechanical transducer such as piezoelectric materials so as to print dots on a recording medium. The electromechanical transducer is in the shape of a plate of a piezoelectric material and forms the walls of ink pressure chambers. The walls oppose each other, defining the ink pressure chamber therebetween. A voltage is applied to the piezoelectric material so as to drive the opposed plates to vibration, the vibration causing the ink in the ink pressure chamber to be ejected through an orifice. This operation is referred to as "drop-on-demand", since the ink is ejected when it is actually demanded.

Recent needs for high speed and high density printing, and color printing place demands on piezoelectricity type ink jet heads to provide a high packing density, a small sized unit, an increased number of ink channels, and an increased drive frequency of ink channels. In order to accommodate such needs, a larger number of piezoelectric elements for printing a single color must be fabricated with a high density. For high definition printing, ink drops must be more closely controlled for stable amounts of ink contained therein and more accurate dot locations when printed on the print medium. Such close control of the ink drops requires controlled speeds of the ejected ink drops. However, the ink-ejecting pressures of many densely fabricated ink chambers vary from chamber to chamber due to manufacture variation, resulting in variations in the amount of ink contained in an ink drop and variations in the speed of the ink drop. This leads to poor yield of ink jet heads during manufacture.

SUMMARY OF THE INVENTION

An object of the invention is to provide a method of adjusting an ink jet head having ink chambers driven by an electromechanical transducer, where the deformation of the electromechanical transducer is adjusted to ensure that ink drops are ejected at the same speed.

Another object of the invention is to provide a method of adjusting an ink jet head where the deformation of the electromechanical transducer is re-adjusted after using the ink jet head for a predetermined time period thereby compensating for deterioration of the ink jet head over time.

The aforementioned objects are achieved by providing a method of adjusting an ink jet head having at least one polarized electromechanical transducer forming an ink chamber from which ink drops are ejected when the electromechanical transducer is deformed.

The method comprises the steps of performing a first polarization operation where the electromechanical transducer is polarized into saturation in a first direction, and performing a second polarization operation where the electromechanical transducer polarized by the first polarization operation is polarized in a second direction opposite to the first direction so that the electromechanical transducer is polarized to a predetermined level.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
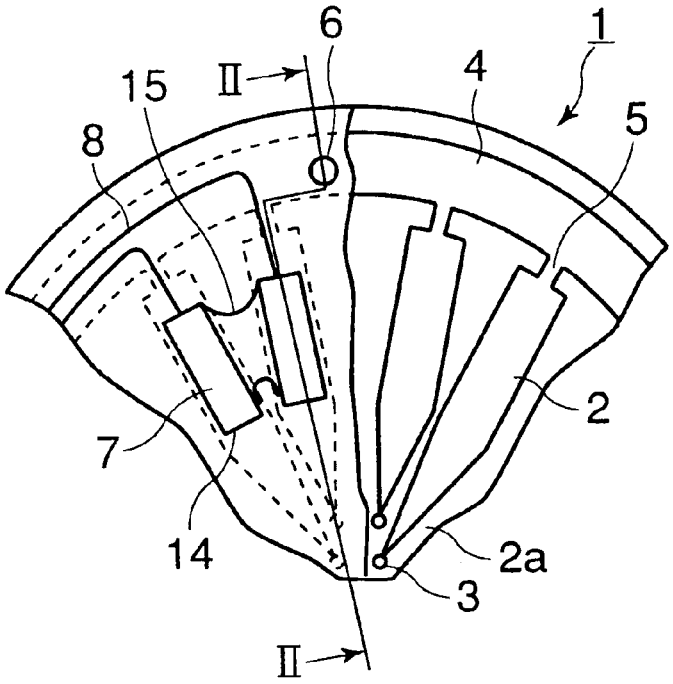
FIG. 1 a fragmentary cutaway top view of an ink jet head according to a first embodiment of the invention.

The present invention will be described in detail by way of preferred embodiments with reference to the accompanying drawings. Like elements have been given like reference numerals throughout the drawings.

First embodiment

FIG. 1 a fragmentary cutaway top view of an ink jet head according to a first embodiment of the invention. Referring to FIG. 1, a plurality of ink pressure chambers 2 are radially arranged in an ink jet head 1. The plurality of ink pressure chambers are required for implementing high speed printing and color-printing. Each ink pressure chamber 2 is provided with an orifice 3 at the end portion 2*a* of the ink pressure chamber 2. Ink drops are ejected through the orifice 3. The arrangement of the orifices 3 varies depending on the construction of the head. In the first embodiment, the orifices 3 are arranged in two inwardly curved rows opposing each other. A common reservoir 4 is provided which extends circumferentially on the outer periphery of the ink jet head 1. The reservoir 4 communicates with the respective ink pressure chambers via paths 5. Provided above the reservoir 4 is an ink replenishing hole 6 through which the ink is replenished when the remaining amount of ink in the reservoir 4 is low. On the respective ink pressure chamber 2 is disposed a piezoelectric element 7 as an electromechanical transducer.

Figure 2:
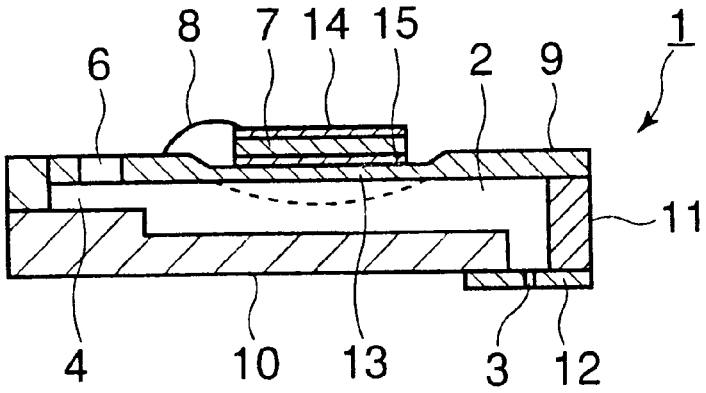
FIG. 2 is a cross-sectional view taken along lines II—II of FIG. 1.

FIG. 2 is a cross-sectional view taken along lines II—II of FIG. 1. The ink pressure chamber 2 and the common reservoir 4 are defined by an upper plate 9, lower plate 10, and center pillar 11. Securely fixed to the lower plate 10 and center pillar 11 is an orifice plate 12 in which the orifices 3 are formed. The upper plate 9 has a diaphragm 13 that is thinner than the other parts of the upper plate 9. The piezoelectric element 7 is sandwiched between an upper electrode 14 and a lower electrode or common electrode 15 securely fixed directly on the diaphragm 13. The piezoelectric element 7 receives a drive voltage via a corresponding lead 8 connected thereto and the drive voltage causes the piezoelectric element 7 to deform as shown in a dotted line in FIG. 2, thereby ejecting ink drops in the ink pressure chamber 2 through the orifice 3. The lower electrode 15 is a common electrode connected to all the piezoelectric elements 7.

First polarization operation

The first polarization operation of the piezoelectric elements 7 will now be described.

First, the upper and lower plates 9 and 10, orifice plate 12, and center pillar 11 are assembled together to form the ink pressure chamber 2 and then the common electrode 15 is bonded to the top of the upper plate 9. Then, the piezoelectric element 7 is bonded on the common electrode 15 by, for example, an electrically conductive bonding agent. Then, upper electrodes 14 are bonded onto the top surfaces of the piezoelectric elements 7 and the leads 8 are connected to the electrodes 14. Alternatively, the electrodes 14 may be formed as follows: The piezoelectric element 7 is first coated with an insulating material, and then a through-hole is formed in the insulating material over the piezoelectric element 7 by photolithography, then an electrically conductive layer is formed in contact with the piezoelectric element 7 in the through-hole by the photolithography, and finally wiring is patterned by the photolithography.

After the above-described assembly, a high voltage is applied across the electrodes 14 and 15 so as to polarize the piezoelectric elements 7. The voltage develops an electric field of about 2–3 kV/mm which causes the relative dielectric constants of the piezoelectric elements to saturate. The dielectric constants $\epsilon$ of the piezoelectric elements 7 are later adjusted to values which result in the speeds of ejected ink drops in the range of 4.5–5.5 m/sec.

The polarization of the piezoelectric element 7 for saturated relative dielectric constant may be performed before the piezoelectric element 7 is assembled to the diaphragm 13, in which case, the electrodes 14 and 15 are bonded to the piezoelectric element 7 before assembling the piezoelectric element 7 to the diaphragm 13 and a voltage is applied across the electrodes 14 and 15 for polarization.

Figure 3:
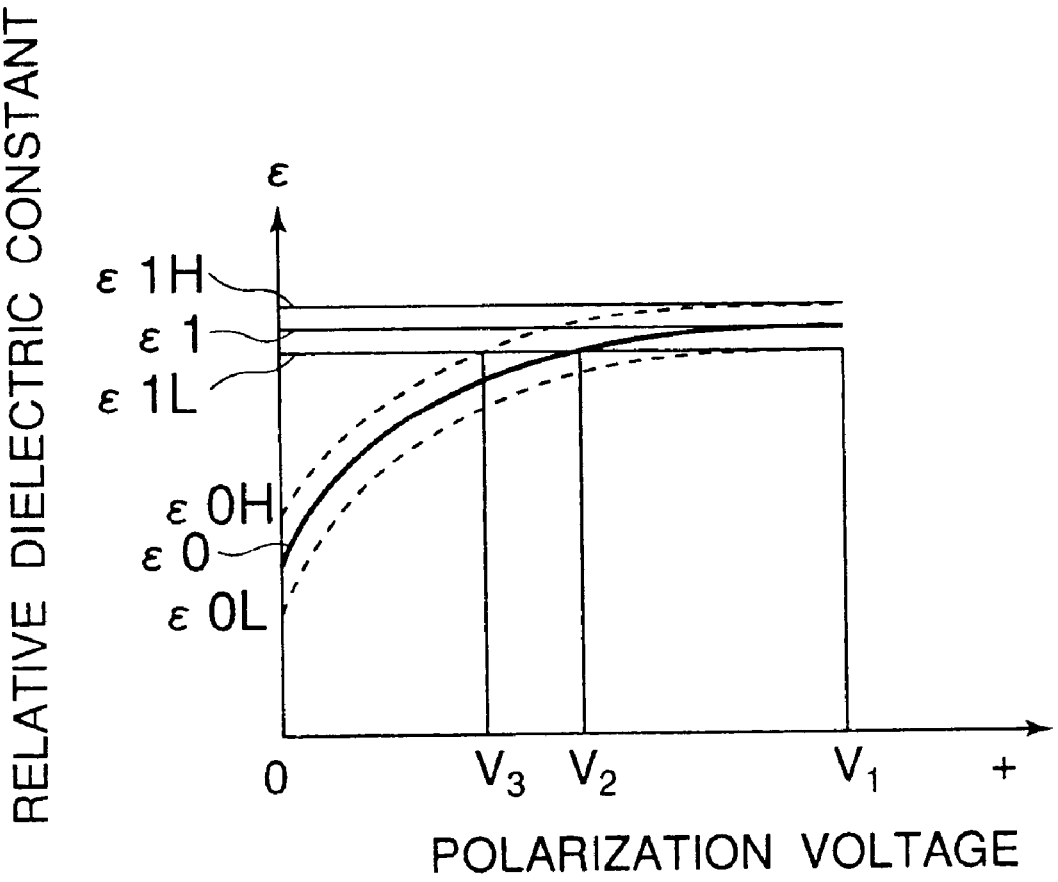
FIG. 3 is a graph showing the variation of relative dielectric constant of a typical piezoelectric element with polarization voltage.

FIG. 3 is a graph showing the variation of relative dielectric constant of a typical piezoelectric element with polarization voltage. FIG. 3 plots polarization voltage as the abscissa and relative dielectric constant as the ordinate. Relative dielectric constants of the dielectric elements before polarization are in the range of $\epsilon_{oL}$–$\epsilon_{oH}$ due to the variations of the materials of the piezoelectric element 7. The term $\epsilon_o$ represents an average relative dielectric constant before polarization. The relative dielectric constants increase with the polarization voltage as shown by dotted lines, reaching their saturated values in the range of $\epsilon_{1L}$–$\epsilon_{1H}$. The term $\epsilon_1$ is an average value of relative dielectric constant after polarization. Generally, a polarization voltage V1 by which the relative dielectric constant $\epsilon$ is saturated (i.e., $\epsilon 1$) is in the range of about 2–3 kv/mm. After polarization, the piezoelectric material is deformed in different directions depending on the orientation of an applied electric field.

When a drive voltage is applied to the polarized piezoelectric element 7 securely assembled to the diaphragm 13, the piezoelectric element 7 is caused to deform as depicted by dotted lines shown in FIG. 2, thereby applying a pressure to the ink pressure chamber 2. The deformation $\delta$ of the diaphragm 13 is given by $$\delta = K \cdot Vc\sqrt{\varepsilon \cdot S} \tag{1}$$

where $\delta$ is the deformation of the diaphragm 3, Vc is the drive voltage, $\epsilon$ is a relative dielectric constant, K is an electromechanical coupling coefficient, and S is a compliance. Equation (1) indicates that the deformation $\delta$ of the diaphragm 13 varies in accordance with the relative dielectric constant $\epsilon$ of the piezoelectric element 7. The drive voltage is usually applied in the same direction as the polarization voltage.

Second polarization operation

In the embodiment, individually adjusting the amounts of deformation $\delta$ of the diaphragms 13 provides a uniform speed of ejected ink drops, thereby improving yield of the ink jet heads during the manufacture.

Figure 4:
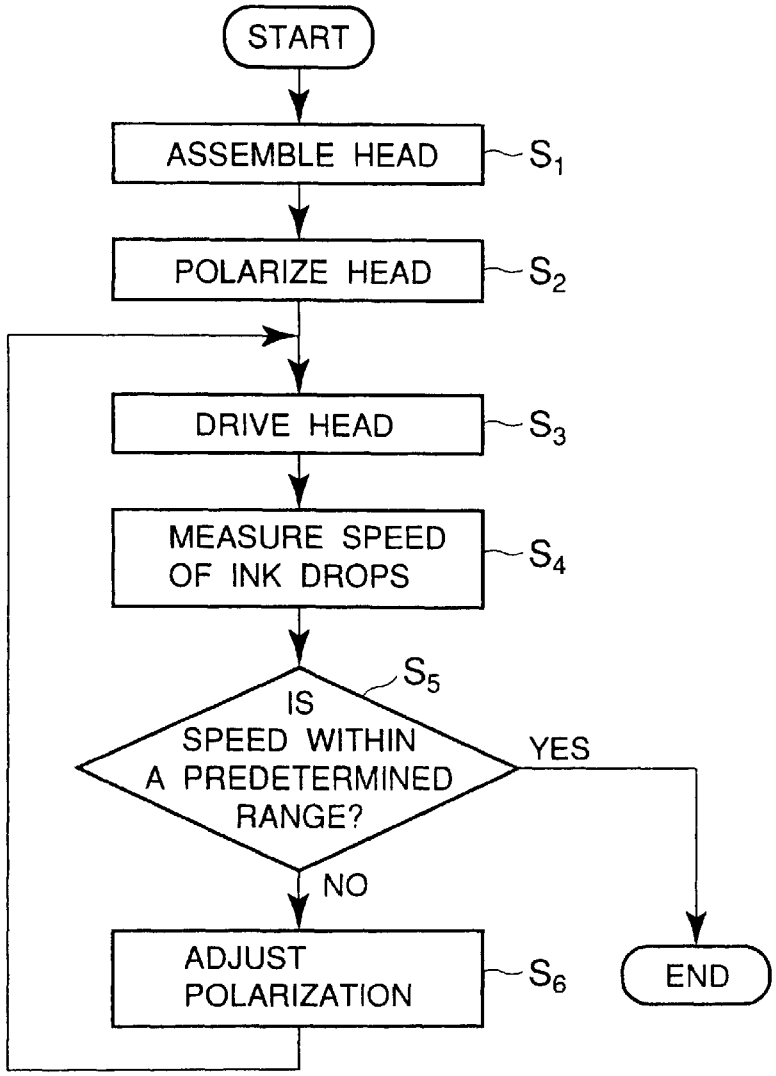
FIG. 4 is a flowchart illustrating the method of adjusting an ink jet head according to the first embodiment.

The second polarization operation will now be described in detail with reference to the flowchart in FIG. 4.

The first polarization operation of the piezoelectric element is performed during the assembly of the ink jet head 1. The ink jet head 1 is assembled at step S1 and the piezoelectric elements 7 are subjected to first polarization operation at step S2. After the first polarization operation, the ink jet head is ready for printing.

Figure 5:
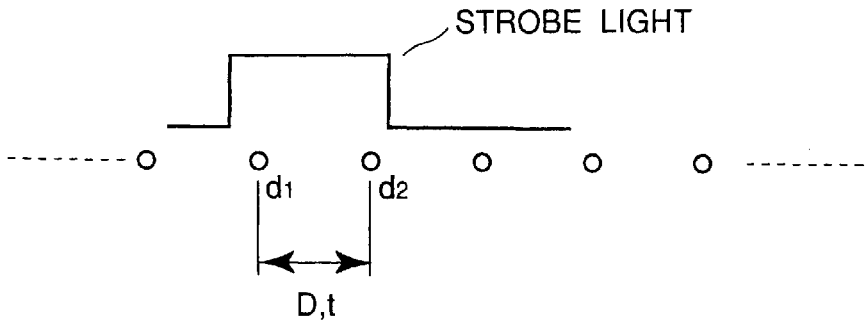
FIG. 5 illustrates how the speed of ink drops is measured using strobe light.

The second polarization operation includes steps S3–S6. A drive voltage Vc is applied to each piezoelectric element 7 at step S3, which drive voltage Vc causes the corresponding diaphragm 13 to deform so that ink drops are ejected from the ink pressure chamber 2 through the orifice 3. The drive voltage applied to the piezoelectric element 7 is in the range of about 10–100 V. The speed of ejected ink drops is measured at step S4. For example, a stroboscope is used to illuminate the ejected ink drops. As shown in FIG. 5, the ink drops are ejected in succession at predetermined time intervals of, for example, t=1 ms and an average speed of the ink drops is determined by measuring the distance between the two consecutive ink drops d1 and d2 as shown in FIG. 5 which are synchronized with the strobe light emitted from the stroboscope. The average speed Va of ink drops is determined by Equation (2) as follows:

$$Va = D/t \tag{2}$$

where the D is the distance between the two ink drops d1 and d2.

If the measured speed of the ink drops is not within a predetermined range, then polarization of the piezoelectric elements 7 is adjusted at steps S5 and S6.

The value of relative dielectric constant is saturated by the first polarization operation at step S2 and therefore a further application of a voltage in the same direction will not increase the values of relative dielectric constant of the piezoelectric elements 7 any further. Thus, the polarization-adjusting voltage in the second polarization operation is applied in a direction opposite to the direction in which the polarization voltage is applied at step S2. Applying a voltage in a reverse direction causes the saturated relative dielectric constant of the piezoelectric element 7 to decrease. The polarization-adjusting voltage is individually applied to the piezoelectric elements 7 so as to individually adjust the relative dielectric constants $\epsilon$ of the piezoelectric elements 7.

The polarization-adjusting voltages applied to the piezoelectric elements 7 are in the range of about 0.5–1 kV/mm. After adjusting the relative dielectric constants, the ink jet head 1 is again driven to eject ink drops so as to measure the speeds of the ejected ink drops.

In this manner, the relative dielectric constants of the piezoelectric elements are decreased to a value such as, for example, $\epsilon_{1L}$ as shown in FIG. 3. A decrease in relative dielectric constant $\epsilon$ results in a decrease in deformation $\delta$ of the diaphragm 13 and hence a decrease in the speed of ink drops. The relative dielectric constants $\epsilon$ of the piezoelectric elements 7 are adjusted to values which result in the speeds of ejected ink drops in the range of 4.5–5.5 m/sec. The speed is selected taking various factors into account, the factors including the speed of the carriage, the gap between the head and the print medium, the minimum speed required for ensuring linear travel of the ink drops, and the maximum possible speed at which no "satellite drops" occur. In operation, the drive voltage develops a lower electric field than the polarization-adjusting voltage and therefore the characteristic of the piezoelectric element 7 is not affected by the drive voltage.

According to the first embodiment, adjusting the polarization of the piezoelectric elements 7 reduces variations in the speed of the ejected ink drops so that a predetermined drive voltage provides consistent head characteristics of the ink pressure chambers in an ink jet head, providing reliable, high quality printing as well as improving the yield of ink jet heads. The aforementioned method of adjusting the polarization of the piezoelectric elements 7 is advantageous in that polarization is adjusted for a uniform speed of ejected ink drops, which is an ultimate desired characteristic of the ink jet head.

Individual adjustment of the polarization of the piezoelectric elements 7 absorbs variations in ink-ejecting pressure resulting from the variations in the adhesion of the adhesive used for bonding the individual piezoelectric elements 7 to the ink pressure chambers, thereby effectively adjusting the speeds of the ejected ink drops to a uniform value as well as offering a high printing quality.

Second embodiment

The relative dielectric constants of the piezoelectric elements adjusted in the first embodiment will change over time. Thus, the relative dielectric constants of the piezoelectric elements are preferably re-adjusted after using the ink jet head for a certain period of time.

Figure 6:
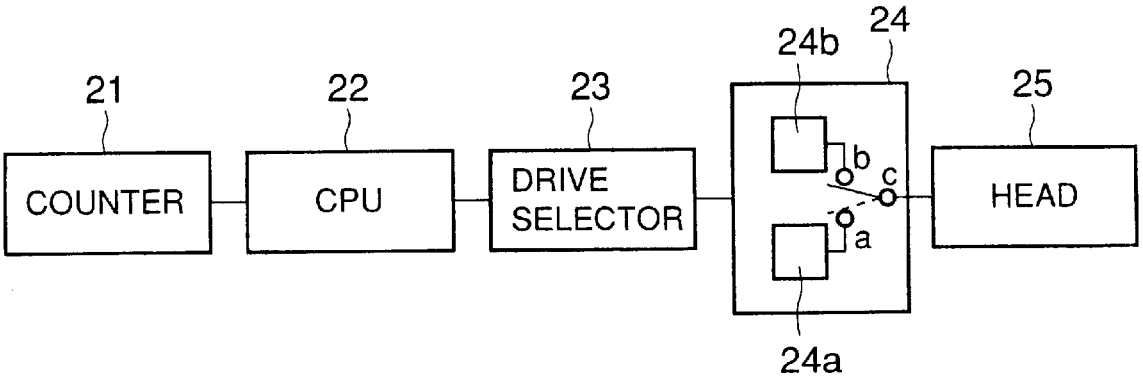
FIG. 6 is a block diagram showing a printer equipped with an ink jet head according to a second embodiment.

FIG. 6 is a block diagram illustrating a printer equipped with an ink jet head according to a second embodiment. The second embodiment is directed to an ink jet head where the polarization of piezoelectric elements is adjusted after the printer is put in practical use.

Referring to FIG. 6, a counter 21 counts the number of times that a typically used channel or ink pressure chamber is driven. A CPU 22 controls the entire operation of the printer. A drive-selector 23 is, for example, a GPIB (General Purpose Interface Bus) and switches between driving supplies 24*a* and 24*b* in a power supply 24 to selectively supply drive voltages to the piezoelectric elements 7 of an ink jet head 25. The driving supply 24*a* drives the ink jet head 25 when printing is performed, and the driving supply 24*b* supplies voltages when the polarization of the piezoelectric elements 7 is performed. The ink jet head 25 is of the same construction as in the first embodiment.

Figure 7:
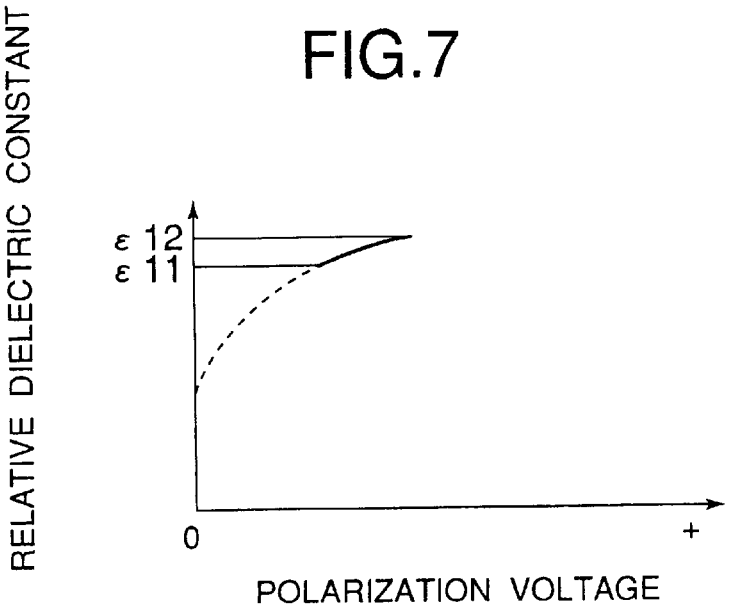
FIG. 7 illustrates values of dielectric constant of the piezoelectric elements according to the second embodiment.
Figure 8:
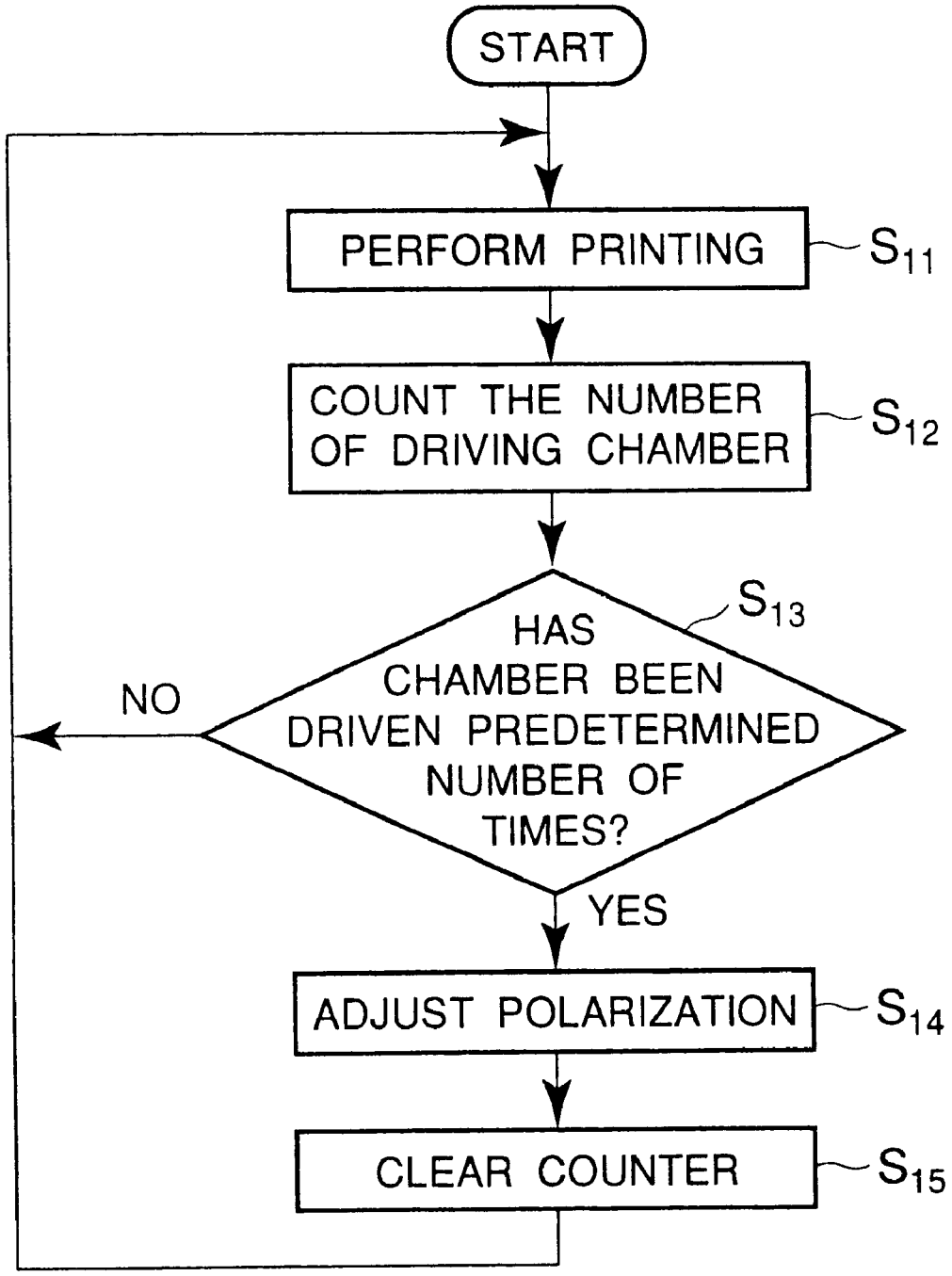
FIG. 8 is a flowchart illustrating the method of adjusting an ink jet head according to the second embodiment.

FIG. 8 is a flowchart illustrating the operation of the second embodiment. The method of adjusting the relative dielectric constants of the piezoelectric elements of the ink jet head 25 according to the second embodiment will now be described with reference to the flowchart in FIG. 8. The adjustment of the relative dielectric constants in the second embodiment is to compensate for decreases in relative dielectric constants with time. The compensation is performed by increasing the relative dielectric constants of the piezoelectric elements to an average value determined experimentally. The ink jet head 25 is provided with piezoelectric elements 7 which have been polarized as described in the first embodiment. The average relative dielectric constant of the piezoelectric elements 7 before re-adjustment of polarization is assumed to have been polarized to $\epsilon_{11}$ as shown in FIG. 7.

Referring to FIG. 8, the printer is operated to print at step S11. The counter 21 counts the number of times a typically used piezoelectric element 7 is driven. Every time printing is performed, the counter 21 counts up at step S12. At step S13, a check is made to determine whether the ink pressure chamber has been driven a predetermined number of times which is previously stored as a reference value in the CPU 22. If YES at step S13, the CPU 22 provides a command to the drive selector 23 to switch at step S14. In response to the command from the CPU 22, the drive selector 23 switches at step S14 from the drive supply 24*a* to the drive supply 24*b*. The CPU 22 provides a command to the drive supply 24*b* which in turn supplies a polarization-adjusting voltage to the piezoelectric element 7 of the ink jet head 25. This polarization-adjusting voltage ranges from 1 kV/mm to 3 kV/mm and is applied in the same direction as the first polarization operation of the piezoelectric elements 7 performed in the first embodiment. By applying the polarization-adjusting voltage, the relative dielectric constants $\epsilon$ of the piezoelectric elements 7 are increased from $\epsilon_{11}$ to $\epsilon_{12}$ as shown in FIG. 7. After performing step S14, the program proceeds to step S15 where the counter 21 is cleared to zero. After increasing the relative dielectric constants $\epsilon$ at step S14–S15, the program jumps back to step S11 where the printing operation is resumed.

The vibration characteristics of the diaphragms 13 deteriorate with an increasing number of times that the head 25 is driven. The deterioration of the vibration characteristics of the diaphragm 13 results in a decrease in the speed of ink drops for the same value of relative dielectric constant of the piezoelectric material 7. Increasing the relative dielectric constants of the piezoelectric elements 7 compensates for the deterioration of the vibration characteristics of the diaphragms 13 and therefore the deterioration of the overall characteristics of the ink jet head 25. In other words, reliable print quality can be ensured irrespective of how often the ink jet head has operated. The same advantage may be obtained if the counter 21 counts the cumulative operating time of a typically used channel.

The present invention is not limited to the aforementioned embodiments and may be modified in a variety of forms within the scope of the invention. For example, while the speeds of ejected ink drops are adjusted to the same value, the relative dielectric constants of the piezoelectric elements may alternatively be adjusted to the same value.

The present invention is applicable not only to the drop-on-demand type ink jet heads but also to the continuous type ink jet heads. In the continuous type ink jet heads, the pressure developed by a pump is used to cause the piezoelectric elements to vibrate, thereby ejecting electrically charged ink drops. The ejected ink drops are selectively deflected by an electric field so that only desired ink drops reach the print medium and unwanted ink drops are recovered into the ink reservoir.

While the present invention has been described with respect to an ink jet head using a piezoelectric element as an electromechanical transducer, the invention may also be applicable to an ink jet head using other types of transducer such as a magnetostrictive element.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of adjusting an ink jet head having an ink pressure chamber, and a polarized electromechanical transducer element that is deformed when a predetermined drive voltage is applied thereto, the ink pressure chamber ejecting an ink drop when the electromechanical transducer element is deformed, said method comprising the steps of:

performing a first polarization operation wherein the entire electromechanical transducer element is polarized to a first polarization level by applying a first polarization voltage in a first predetermined direction; and performing a second polarization operation wherein the polarization of the electromechanical transducer element is adjusted by applying a second polarization adjusting voltage either in the first direction or in a second direction opposite to the first direction, the polarization of the entire electromechanical transducer element being adjusted from the first polarization level to a second polarization level such that the ink pressure chamber ejects the ink drop at a speed that is within a predetermined range.

2. The method according to claim 1, wherein the first polarization level is a saturated polarization level.

3. The method according to claim 1, wherein said ink jet head includes a plurality of ink pressure chambers, each having a corresponding electromechanical transducer element, and said performing the first polarization operation is conducted for the plurality of ink pressure chambers by simultaneously applying the first polarization voltage to the corresponding electromechanical transducer element of each of the plurality of ink pressure chambers.

4. The method according to claim 1, wherein said ink jet head includes a plurality of ink pressure chambers, each having a corresponding electromechanical transducer element, and said performing the second polarization operation is conducted for the plurality of ink pressure chambers by applying a plurality of second polarization adjusting voltages, a respective one of said plurality of second polarization adjusting voltages to each of the corresponding electromechanical transducer elements.

5. The method according to claim 4, further including:

performing an additional polarization operation after the ink jet head has ejected a predetermined number of ink drops, wherein the additional polarization operation is performed such that the electromechanical transducer elements are polarized to another polarization level that is higher than an average of the second polarization levels by applying a third polarization adjusting voltage in a direction that is the same as the direction in which the electromechanical transducer elements have been polarized by the second polarization operation.

6. The method according to claim 1, wherein said method further includes:

applying the drive voltage, after the first polarization operation and before the second polarization operation, to the electromechanical transducer element at predetermined time intervals to cause the ink pressure chamber to eject ink drops, and measuring speeds of the ejected ink drops.

7. A method of adjusting a characteristic of an ink drop ejected from an ink jet head having an ink pressure chamber, and an electromechanical transducer element that is deformed when a drive voltage is applied thereto, the ink pressure chamber ejecting an ink drop when the electromechanical transducer element is deformed, said method comprising the steps of:

performing a first polarization operation wherein the electromechanical transducer element is polarized by applying a first voltage;

applying the drive voltage to the electromechanical transducer element and measuring the characteristic of an ink drop that is subsequently ejected from the ink pressure chamber;

performing a second polarization operation by applying a second voltage to the electromechanical transducer element in accordance with the measured characteristic of the ink drop to provide an adjusted polarization of the electromechanical transducer element; and applying the drive voltage to the electromechanical transducer element to produce an ink drop having a predetermined characteristic.

8. The method according to claim 7, wherein the characteristic of the ink drop is a speed of the ink drop ejected from the ink jet head.

9. The method according to claim 8, wherein the second voltage is greater than the first voltage and is applied in a direction that is the same as a direction of the first voltage, if the measured speed of the ink drop is lower than a lower limit of predetermined range.

10. The method according to claim 8, wherein if the measured speed of the ink drop is higher than a higher limit of a predetermined range, the second voltage is applied in a direction that is opposite to a direction in which the first voltage is applied.

11. The method according to claim 7, wherein the characteristic of the ink drop includes a size and a speed of the ink drop ink ejected from the ink jet head.

* * * * *